US005993130A

United States Patent [19]

Theurer et al.

[11] Patent Number: 5,993,130

[45] Date of Patent: Nov. 30, 1999

[54] LOADING CAR FOR BULK MATERIAL

[75] Inventors: Josef Theurer, Vienna; Manfred Brunninger, Altenberg; Friedrich Oellerer, Linz, all of Austria

[73] Assignee: Franz Plasser Bahnbaumaschinen-Industriegesellschaft mbH., Vienna, Austria

[21] Appl. No.: 08/971,826

[22] Filed: Nov. 17, 1997

[30] Foreign Application Priority Data

Nov. 20, 1996 [AT] Austria ..... 2021/96

[51] Int. Cl.[6] ..... B65G 67/00

[52] U.S. Cl. ..... 414/339; 414/505; 414/523; 414/528

[58] Field of Search ..... 414/339, 528, 414/503–505, 340, 523

[56] References Cited

U.S. PATENT DOCUMENTS

| | | | |
|---|---|---|---|
| 4,576,538 | 3/1986 | Theurer et al. | 414/339 |
| 4,809,617 | 3/1989 | Theurer et al. | 414/528 X |
| 4,923,355 | 5/1990 | Mancini | 414/528 X |
| 5,151,002 | 9/1992 | Theurer et al. | 414/339 |
| 5,203,662 | 4/1993 | Theurer et al. | 414/528 X |
| 5,219,262 | 6/1993 | Theurer et al. | 414/505 |
| 5,400,718 | 3/1995 | Theurer et al. | 414/528 X |
| 5,470,175 | 11/1995 | Jensen et al. | 414/505 X |

FOREIGN PATENT DOCUMENTS 2 277 725 3/1996 United Kingdom .

*Primary Examiner*—David A. Bucci
*Attorney, Agent, or Firm*—Henry M. Feiereisen

[57] ABSTRACT

A loading car for bulk material for incorporation in a freight train of a plurality of successively arranged like loading cars, includes a box open on top and mounted on a frame for storing bulk material. A bottom conveyor is disposed in a lower portion of the box and has opposite conveyor ends spaced from one another in the longitudinal direction. Positioned between the boxes of two successive cars, each loading car has a transfer conveyor arrangement which projects beyond the frame and is angularly adjustable with respect to the bottom conveyor, with the transfer conveyor arrangement including two separate transfer conveyors, with one of the two transfer conveyors cooperating with one of the conveyor ends and the other one of the two transfer conveyors cooperating with the other one of the conveyor ends so as to allow a reversal of the conveying direction for the bulk material.

4 Claims, 3 Drawing Sheets

LOADING CAR FOR BULK MATERIAL

BACKGROUND OF THE INVENTION

The present invention generally refers to material transportation, and more specifically to a loading car for bulk material useful for incorporation in a freight train of a series of successively arranged like loading cars. In particular, the present invention refers to a loading car of a type having a box which is open on top and mounted to a frame for storing bulk material, an endless bottom conveyor positioned in a lower portion of the box in a longitudinal direction of the car and having two conveyor ends spaced from one another in the longitudinal direction, and a transfer conveyor extending at an angle to the bottom conveyor and projecting beyond the frame.

U.S. Pat. No. 4,576,538 discloses a loading car of this type which when coupled together with other like loading cars to form a freight train provides a continuous conveyance path along the length of the train so that bulk material can be dumped into the box at one end and transported to the opposite end. The drive for the bottom conveyor, typically a conveyor band, can be operated at variable speed so that a slow conveying speed results in a slow advance of bulk material enabling the box car to be fully charged. A higher conveying speed, on the other hand, allows a transport of bulk material to the preceding box car without intermediate storage. This type of loading train permits a transport of e.g. waste material generated by a cleaning machine from the adjacent end of the loading train via the respective bottom and transfer conveyors, typically also conveyor bands, to the leading box car for storage. The projecting transfer conveyor is swingable about a vertical axis so as to allow unloading of all box cars at the same time.

British Pat. No. GB 2,277,725 also describes a loading car of this type in which the transfer conveyor is swingably mounted in an area of its lower conveyor end in order to allow the transfer conveyor to be vertically adjustable by a drive from a first upper end position effecting a transfer of bulk material to the successive loading car into a second lower end position for discharge of stored bulk material directly onto the track at smaller height of drop.

U.S. Pat. No. 5,151,002 discloses a loading car which includes two parallel bottom conveyors positioned side-by-side and two parallel transfer conveyors in side-by-side disposition, with the bottom and transfer conveyors so positioned that the conveyor end of a bottom conveyor is either disposed below or above the conveyor end of the transfer conveyor so that a continuous conveyance path is provided with the conveyor ends of the transfer conveyor alternatingly disposed beneath and above the facing conveyor ends of successive bottom conveyors. Both bottom conveyors are separated from one another by a central, longitudinally extending partition, with each bottom conveyor being associated to a separate box. Although this dual arrangement of two conveyor arrangements allows parallel storage and/or transport of bulk material in two opposite conveying directions, each conveyor arrangement can be operated only in one conveying direction.

SUMMARY OF THE INVENTION

It is thus an object of the present invention to provide an improved loading car for bulk material, obviating the aforestated drawbacks.

In particular, it is an object of the present invention to provide an improved loading car for bulk material, capable of reversing the transport direction for the bulk material in a simple manner, without requiring complex manipulations.

These objects, and others which will become apparent hereinafter, are attained in accordance with the present invention by providing for each conveyor end of the bottom conveyor a separate transfer conveyor.

By assigning a separate transfer conveyor to each conveyor end of the bottom conveyor, the transport or conveying direction can be selected through operation of one or the other transfer conveyor for a transfer of bulk material to the next loading car. The change of the transport direction can be executed in a very short time, without requiring time-consuming and temporary uncoupling of the loading car. Moreover, the clearance gauge remains unaffected during change-over so that traffic on a neighboring track cannot pose any safety hazards.

Advantageously, each car center proximate conveyor end of both transfer conveyors is pivoted to a carriage which is slidably mounted for displacement in the longitudinal direction of the machine frame relative thereto by means of a drive. In this manner, the one transfer conveyor that is not in use can be shifted into a secure idle position between the machine frame and the bottom conveyor without impeding the bulk material transport. The reversal of the conveying direction requires merely a simultaneous shift of both transfer conveyors into the operative position and idle position, respectively.

According to another feature of the present invention, the transfer conveyors have in a direction transversely to the longitudinal direction a width which is about half a width of the first conveyor arrangement, whereby the transfer conveyors are preferably arranged in offset disposition with respect to a center line oriented in the longitudinal direction and extending centrally with respect to a direction transverse to the longitudinal direction.

According to still another feature of the present invention, each conveyor end of the bottom conveyor cooperates with a screw conveyor which rotates about a horizontal axis and extends perpendicular to the longitudinal direction.

In order to provide an even distribution over the bottom conveyors during transport of bulk material, the higher conveyor end of each transfer conveyor cooperates with a deflection device for diverting dumped bulk material in a direction towards the one side wall of the box that is further distanced from the respective transfer conveyor.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
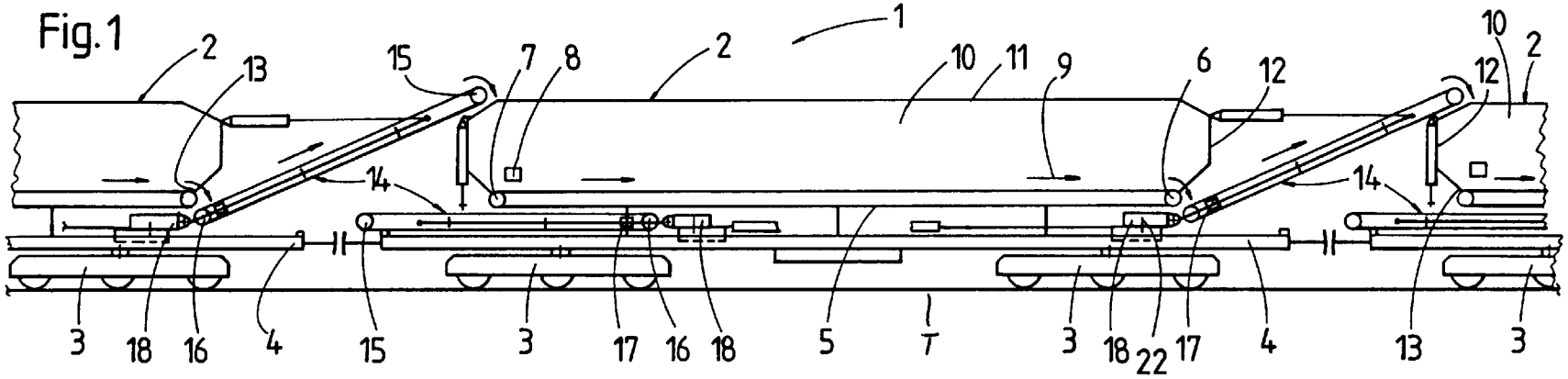
FIG. 1 is a side elevational view of one embodiment of a loading car in accordance with the present invention, incorporated in a freight train which is comprised of a plurality of such loading cars, and showing a transfer conveyor arrangement in one operative position.

Throughout all the Figures, the same or corresponding elements are generally indicated by the same reference numerals.

Turning now to the drawing, and in particular to FIG. 1, there is shown a side elevational view of a first embodiment of a loading car according to the present invention, generally designated by reference numeral 2. The loading car 2 may be coupled together with any number of such loading cars to form a freight train, generally designated by reference numeral 1, and includes a plateau-like machine frame 4 which extends longitudinally along a track T and is supported by undercarriages 3 for mobility along the track T. Mounted to the machine frame 4 is a conveyor arrangement 5 which extends longitudinally in direction of the machine frame 4. The conveyor arrangement 5 is formed by an endless conveyor band which is driven by a drive 8 for transport of bulk material between opposite conveyor ends 6, 7 either in direction as indicated by arrow 9 in FIG. 1 or in opposite direction as indicated by arrow 90 in FIG. 2. Two parallel side walls 11 extend in the longitudinal direction alongside the conveyor arrangement 5, and two end walls 12 are positioned perpendicular to the longitudinal direction, to thereby form a storage box 10 for bulk material, with the conveyor arrangement 5 constituting the bottom of the box 10 and the side walls 11 constituting the lateral confines. Each of the end walls 12 is spaced with its the lower portion from the conveyor arrangement 5 to form an outlet opening 13.

Each conveyor end 6, 7 of the conveyor arrangement 5 cooperates with a separate transfer conveyor arrangement, generally designated by reference numeral 14 and including an endless conveyor band which extends in the longitudinal direction of the machine frame 4, and a drive 17 for operating the transfer conveyor band between two conveyor ends 15, 16. Each transfer conveyor arrangement 14 is pivoted at its conveyor end 16 that is positioned closer to the car center to a carriage 18 which is movably mounted to the machine frame 4 for displacement in the longitudinal direction by means of a drive 19 and is swingable about a vertical axis 22 relative to the machine frame 4.

During operation and transport of bulk material in conveying direction indicated by arrow 9 in FIG. 1, the leading transfer conveyor arrangement 14 of the loading car 2 ascends at an angle to the horizontal so that the conveyor end 15 is situated higher than the opposite conveyor end 16, with the higher conveyor end 15 being spaced at a distance from the conveyor end 7 of the bottom conveyor arrangement 5 of the preceding loading car 2 for dumping bulk material into the box 10 thereof, and with the lower conveyor end 16 of the transfer conveyor arrangement 14 being positioned underneath the leading conveyor end 6 of the bottom conveyor arrangement 5. The trailing transfer conveyor arrangement 14 occupies its idle, substantially horizontal, position between the machine frame 4 and the bottom conveyor arrangement 5.

Figure 2:
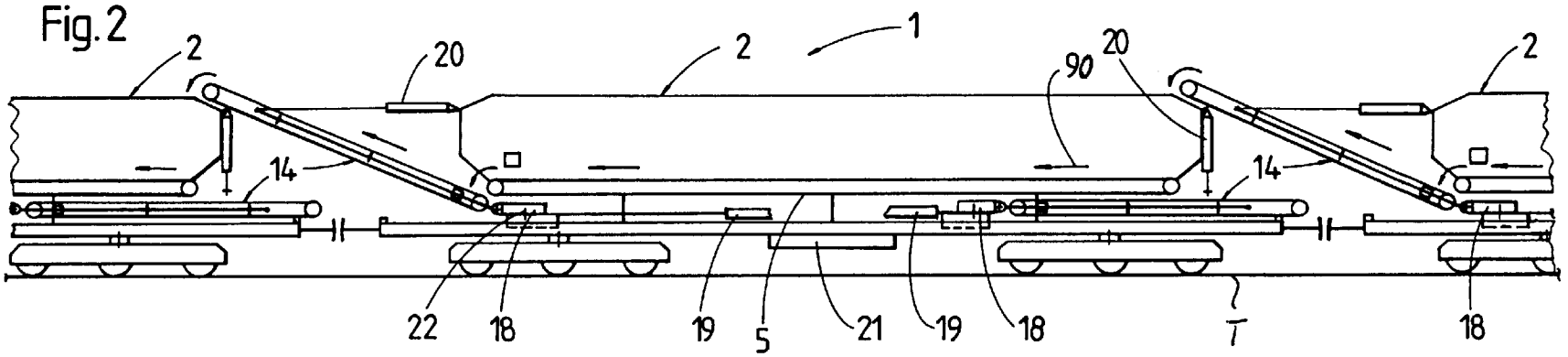
FIG. 2 is a side elevational view of the loading car of FIG. 1, showing the transfer conveyor arrangement in another operative position.

When reversing the transport direction to move bulk material in opposite direction as indicated by arrow 90 in FIG. 2, drive 19 of the transfer conveyor arrangement 14 in operative position is actuated to move this transfer conveyor arrangement 14 into the idle position between the machine frame 4 and the bottom conveyor arrangement 5. Subsequently, the drive 19 for the previously idle transfer conveyor arrangement on the opposite conveyor end 7 is actuated to move this transfer conveyor arrangement 14 into the operative inclined position, as shown in FIG. 2. A support device 20 formed by a hydraulic cylinder and rope is used to elevate and support the transfer conveyor arrangement 14 during change-over into the operative position. When reversing the transport direction for bulk material, the conveyor drive 8 is operated in opposite rotational direction. A power source 21 is placed underneath the machine frame 4 to provide the supply of energy for the various drives.

Figure 3:
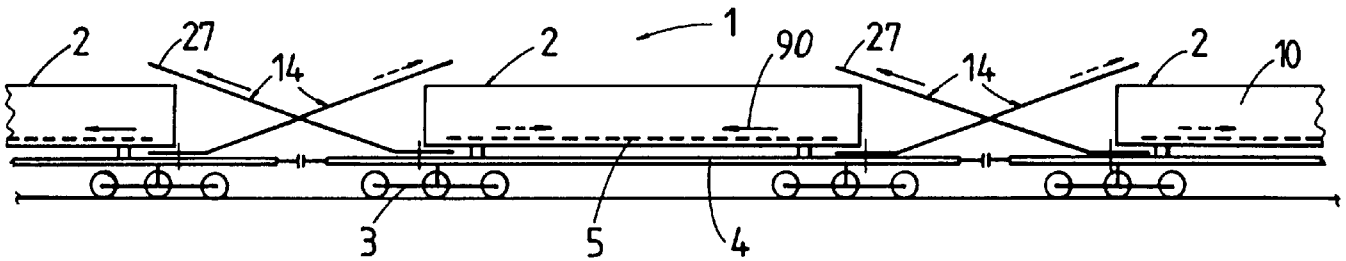
FIG. 3 is a schematic side elevational view of another embodiment of a loading car with two transfer conveyor arrangements in side-by-side disposition in direction transverse to the machine frame.
Figure 4:
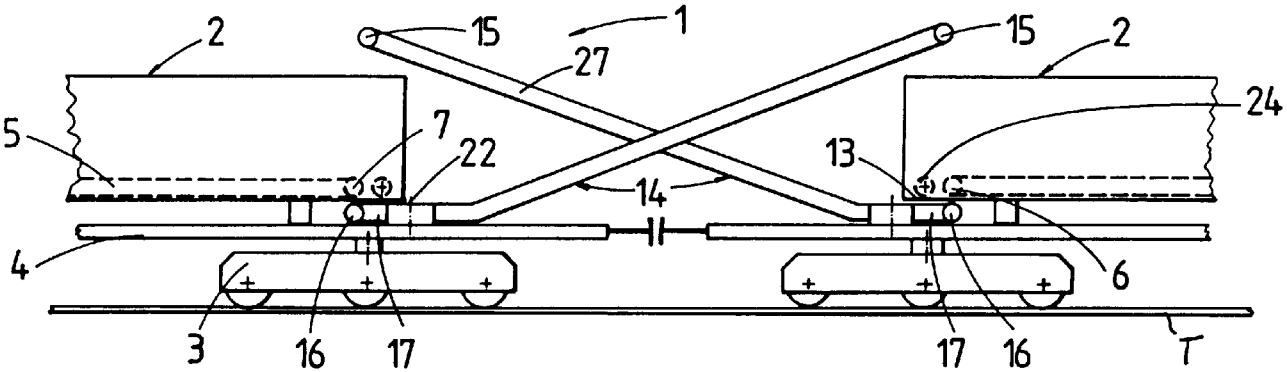
FIG. 4 is a more detailed side elevational view of the loading car of FIG. 3.
Figure 5:
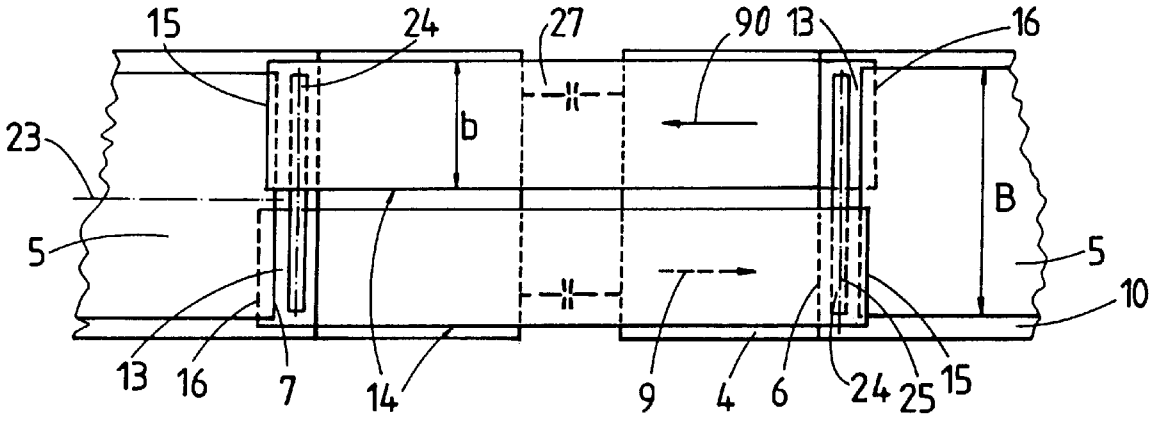
FIG. 5 is a fragmentary top plan view, on an enlarged scale, of both transfer conveyor arrangements of FIG. 3.

Turning now to FIGS. 3–5, there are shown schematic side elevational views of another embodiment of a loading car 2 which differs from the loading car 2 shown in FIG. 1 by the provision of two transfer conveyor arrangements 14 in side-by-side disposition in direction transverse to the machine frame 4. As best seen in FIG. 5 which is a fragmentary top plan view, on an enlarged scale, each of both transfer conveyor arrangements 14 is defined in transverse direction of the machine frame 4 by a width b which corresponds substantially to half the width B of the bottom conveyor arrangement 5. As a result of such a configuration, both transfer conveyor arrangements 14 of two successive loading cars 2 can continuously occupy their operative position whereby only one of both transfer conveyor arrangements 14 is in operation.

A further difference of the loading car 2 according to FIGS. 3 to 5 from the embodiment of FIG. 1 resides in the fact that each transfer conveyor arrangement 14 is swingably mounted directly on the machine frame 4 for rotation about the vertical axis 22. The two transfer conveyor arrangements 14 of each loading car 2 which are spaced from one another in the longitudinal direction are offset to one another with respect to a center line 23 extending in the longitudinal direction and disposed centrally in direction transverse to the longitudinal direction. The outlet opening 13 located in the area of each conveyor end 6, 7 of the bottom conveyor arrangement 5 also is defined by a width in correspondence to the width b of the transfer conveyor arrangement 14 and is located above the subjacent conveyor end 16 of the respective transfer conveyor arrangement 14. Placed in the area of the box half 10 that is opposite to the outlet opening 13 in transverse direction is a screw conveyor 24 defined by a horizontal rotational axis 25 extending perpendicular to the longitudinal direction. The screw conveyor 24 is situated in the area of the conveyor end 6 and 7, respectively, of the bottom conveyor arrangement 5.

Figure 6:
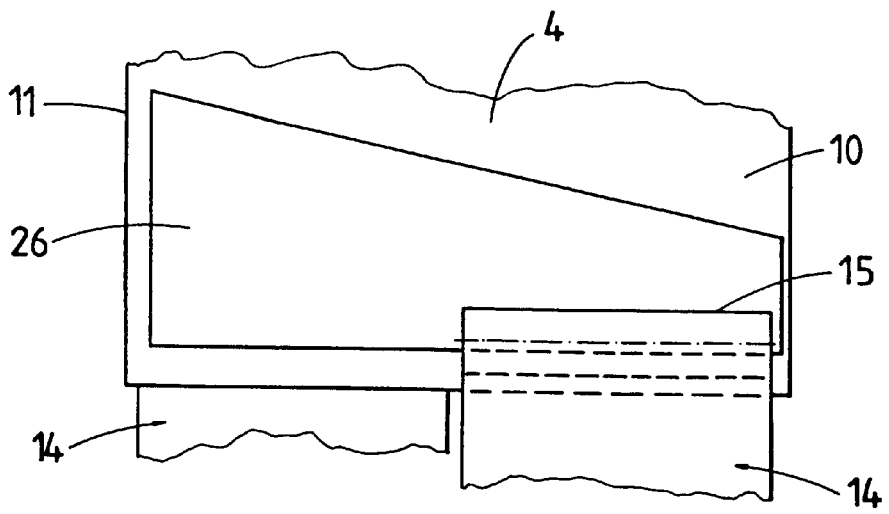
FIG. 6 is a cutaway view, on an enlarged scale, of the loading car, of FIG. 3, showing in detail the higher conveyor end of the transfer conveyor arrangement in conjunction with a deflection device.
Figure 7:
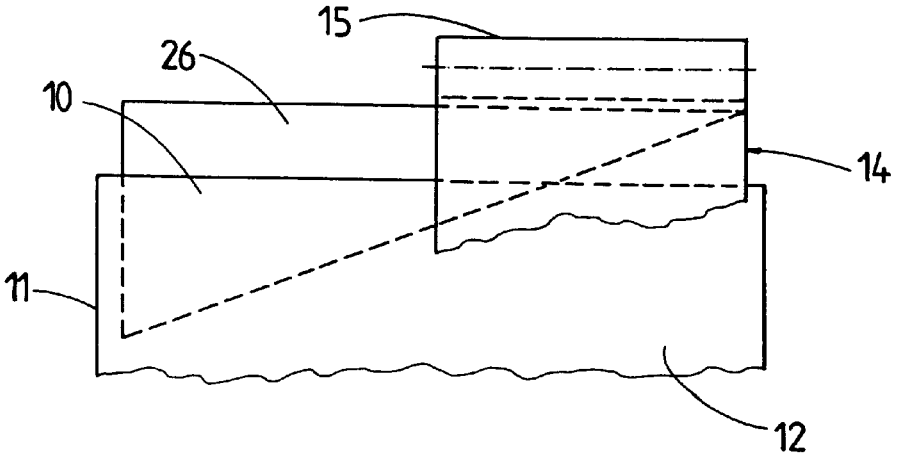
FIG. 7 is a cutaway view of the higher conveyor end of FIG. 6 in longitudinal direction of the machine frame.

As shown in FIGS. 6 and 7, each higher conveyor end 15 of the transfer conveyor arrangement 14 cooperates with a deflection device 26 for diverting part of the dumped bulk material in direction to the side wall 11 of the box 10 that is further distanced from the transfer conveyor arrangement 14.

In the event, bulk material is intended to be transported from right to left in the projection shown in FIGS. 3 to 5, as indicated by arrow 9, only the one transfer conveyor arrangement 14 of the loading car 2 is in operation that occupies a forward position in transport direction of the bulk material. For ease of understanding the transfer conveyor arrangements in operative position are denoted by reference numeral 27. Bulk material conveyed by the bottom conveyor arrangement 5 in direction to the conveyor end 6 is conveyed by the screw conveyor 24 in direction toward the outlet opening 13 and further conveyed together with the remaining bulk material by the operative transfer conveyor arrangement 27 to the preceding loading car 2. The deflection device 26 effects an even distribution of bulk material, dumped at the conveyor end 15 only in the area of one car half, across the entire width B of the bottom conveyor arrangement 5 and thus across the entire width of the box 10.

The deflection device 26 may be designed in the form of a baffle plate. Certainly, other designs may also be conceivable to effect an even distribution of bulk material over the entire width B. e.g. the use of a screw conveyor immediately above the bottom conveyor arrangement.

Figure 8:
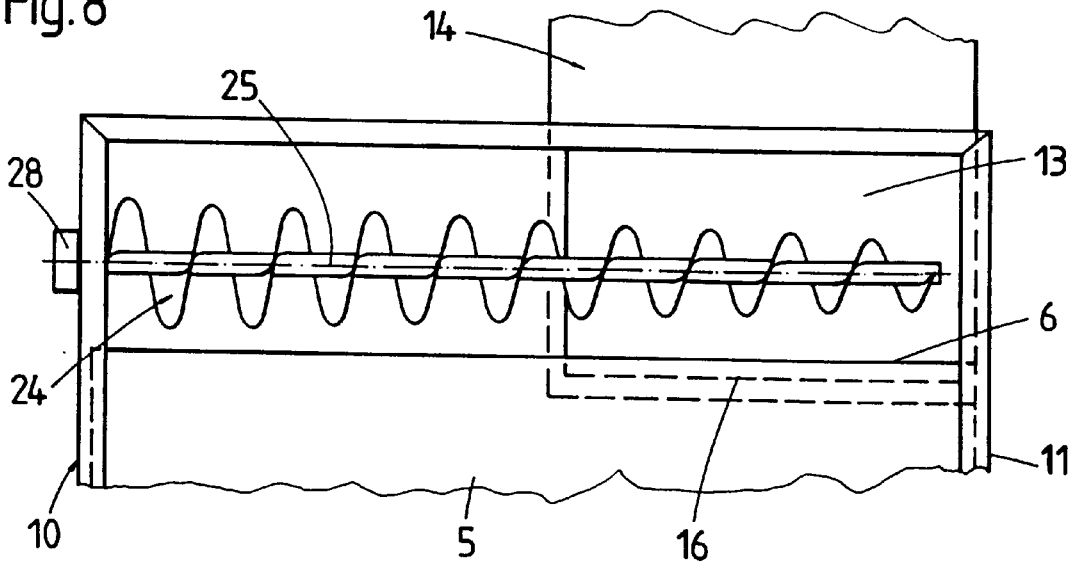
FIG. 8 is a top plan view of a screw conveyor mounted on the loading car of FIG. 3.

Turning now to FIG. 8, there is shown a top plan view of the screw conveyor 24 which is adapted for rotation by means of a drive 28 and conveys in the direction of the outlet opening 13 that part of bulk material that is situated on the box half that opposes the outlet opening 13 in transverse direction.

A reversal of the conveying direction requires only to idle the drives 17 of the previously operative transfer conveyor arrangements 27, to operate the drives 17 for the transfer conveyor arrangements 5 located adjacent in transverse direction, and to reverse the drives 8 of the bottom conveyor arrangements 5 for movement in opposite direction.

While the invention has been illustrated and described as embodied in a loading car, it is not intended to be limited to the details shown since various modifications and structural changes may be made without departing in any way from the spirit of the present invention.

What is claimed as new and desired to be protected by Letters Patent is set forth in the appended claims:

1. A loading car for bulk material for incorporation in a freight train of a plurality of successively arranged like loading cars, said loading car comprising:

a frame extending in a longitudinal direction;

a box open on top and mounted on the frame for storing bulk material;

a first conveyor arrangement including an endless conveyor formed at a lower portion of the box and having opposite conveyor ends spaced from one another in the longitudinal direction, and a drive for operating the conveyor; and a second transfer conveyor arrangement projecting beyond the frame and angularly adjustable with respect to the first conveyor arrangement, said second conveyor arrangement including two separate transfer conveyors, with one of the two transfer conveyors cooperating with one of the conveyor ends and the other one of the two transfer conveyors cooperating with the other one of the conveyor ends, wherein the transfer conveyor arrangement includes two carriages slidably mounted to the frame and a drive means for displacement of the carriages in the longitudinal direction, each of the transfer conveyors having a conveyor end facing a center of the frame, with the conveyor end of one of the transfer conveyors being pivoted to one of the carriages and with the conveyor end of the other one of the transfer conveyors being pivoted to the other one of the carriages.

2. The loading car of claim 1 wherein each one of the carriages is swingably mounted for rotation about a vertical axis.

3. A loading car, comprising:

a frame defining an axis;

a first conveyor secured to the frame and adapted for allowing transport of a material in two directions between opposing conveyor ends spaced from one another in direction of the axis;

a second conveyor adjustably mounted to the frame in proximity of one conveyor end for receiving material from the first conveyor when running in one direction; and a third conveyor adjustably mounted to the machine frame in proximity of the other conveyor end for receiving material from the first conveyor when running in the other direction, wherein each one of the second and third conveyors is adjustable in a direction of the axis between an operative position for receiving material and an idle position.

4. The loading car of claim 3 adapted for transport of bulk material, with the loading car being part of a freight train comprised of a plurality of successively arranged like loading cars.

* * * * *